US009921526B2

(12) United States Patent
Takahashi et al.

(10) Patent No.: US 9,921,526 B2
(45) Date of Patent: Mar. 20, 2018

(54) SEMICONDUCTIVE RESIN COMPOSITION, MEMBER FOR ELECTROPHOTOGRAPHY AND IMAGE FORMING APPARATUS

(71) Applicants: Hiroaki Takahashi, Kanagawa (JP); Hideaki Yasunaga, Tokyo (JP); Akira Izutani, Osaka (JP); Makoto Matsushita, Tokyo (JP); Keiichiro Juri, Kanagawa (JP); Yuri Haga, Kanagawa (JP); Ayano Momose, Tokyo (JP)

(72) Inventors: Hiroaki Takahashi, Kanagawa (JP); Hideaki Yasunaga, Tokyo (JP); Akira Izutani, Osaka (JP); Makoto Matsushita, Tokyo (JP); Keiichiro Juri, Kanagawa (JP); Yuri Haga, Kanagawa (JP); Ayano Momose, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 58 days.

(21) Appl. No.: 14/967,827

(22) Filed: Dec. 14, 2015

(65) Prior Publication Data

US 2016/0202638 A1 Jul. 14, 2016

(30) Foreign Application Priority Data

Jan. 9, 2015 (JP) ..... 2015-003181
Mar. 13, 2015 (JP) ..... 2015-051431
Sep. 4, 2015 (JP) ..... 2015-174678

(51) Int. Cl.
*H01B 1/24* (2006.01)
*G03G 15/01* (2006.01)
(Continued)

(52) U.S. Cl.
CPC ..... *G03G 15/162* (2013.01); *G03G 9/0825* (2013.01); *G03G 15/1685* (2013.01); *H01B 1/24* (2013.01)

(58) Field of Classification Search
None
See application file for complete search history.

(56) References Cited

U.S. PATENT DOCUMENTS 4,929,388 A * 5/1990 Wessling ..... H01B 1/12 252/500
2001/0016531 A1 8/2001 Morikoshi et al.
(Continued)

FOREIGN PATENT DOCUMENTS

EP 1112837 A1 7/2001
EP 1650609 A1 4/2006
(Continued)

OTHER PUBLICATIONS

English text machine translation of Kusaba et al. (JP 2005-164674), accessed on the JPO AIPN website; copy attached as a PDF pp. 1-12.*

(Continued)

*Primary Examiner* — Katie L Hammer
(74) *Attorney, Agent, or Firm* — Cooper & Dunham LLP

(57) ABSTRACT

A semiconductive resin composition includes at least two thermoplastic resins and a conductive filler. Each of the two thermoplastic resins has a sea-island structure, and 40% to 75% of the conductive filler are present in the thermoplastic resin in an island portion of the sea-island structure at an areal ratio of a cross section observed with a scanning electron microscope.

9 Claims, 3 Drawing Sheets

(51) Int. Cl.
*G03G 15/16* (2006.01)
*G03G 9/08* (2006.01)

(56) References Cited

U.S. PATENT DOCUMENTS

| | | | |
|---|---|---|---|
| 2002/0061210 | A1 | 5/2002 | Ashibe et al. |
| 2003/0054279 | A1 | 3/2003 | Yamaguchi et al. |
| 2003/0143000 | A1 | 7/2003 | Takahashi et al. |
| 2003/0224279 | A1 | 12/2003 | Kotsugai et al. |
| 2004/0142269 | A1 | 7/2004 | Kotsugai et al. |
| 2005/0064315 | A1 | 3/2005 | Yamaguchi et al. |
| 2006/0172097 | A1 | 8/2006 | Morikoshi et al. |
| 2006/0204882 | A1 | 9/2006 | Nozaki et al. |
| 2006/0210908 | A1 | 9/2006 | Umemura et al. |
| 2006/0275686 | A1 | 12/2006 | Kadota et al. |
| 2007/0059625 | A1 | 3/2007 | Yamamoto et al. |
| 2007/0122729 | A1 | 5/2007 | Katoh et al. |
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0238042 | A1 | 10/2007 | Yasunaga et al. |
| 2008/0038656 | A1 | 2/2008 | Yasunaga et al. |
| 2008/0063957 | A1 | 3/2008 | Murakami et al. |
| 2008/0069594 | A1 | 3/2008 | Izutani |
| 2008/0069598 | A1 | 3/2008 | Murakami et al. |
| 2008/0069599 | A1 | 3/2008 | Nakamura et al. |
| 2008/0069605 | A1 | 3/2008 | Fuwa et al. |
| 2008/0069608 | A1 | 3/2008 | Katoh et al. |
| 2008/0070149 | A1 | 3/2008 | Kato et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0199234 | A1 | 8/2008 | Hagi et al. |
| 2008/0226356 | A1 | 9/2008 | Yasunaga et al. |
| 2008/0226997 | A1 | 9/2008 | Nakamura et al. |
| 2008/0227009 | A1 | 9/2008 | Fuwa et al. |
| 2008/0232849 | A1 | 9/2008 | Izutani et al. |
| 2008/0232864 | A1 | 9/2008 | Izutani et al. |
| 2008/0233506 | A1 | 9/2008 | Hagi et al. |
| 2008/0279591 | A1 | 11/2008 | Yasunaga et al. |
| 2008/0304875 | A1 | 12/2008 | Katoh et al. |
| 2009/0041511 | A1 | 2/2009 | Fuwa et al. |
| 2009/0052952 | A1 | 2/2009 | Katoh et al. |
| 2009/0060540 | A1 | 3/2009 | Matsushita et al. |
| 2009/0117481 | A1 | 5/2009 | Yasunaga et al. |
| 2009/0142107 | A1 | 6/2009 | Akira et al. |
| 2009/0169270 | A1 | 7/2009 | Fuwa et al. |
| 2009/0180791 | A1 | 7/2009 | Matsushita et al. |
| 2009/0186289 | A1 | 7/2009 | Nakamura et al. |
| 2009/0186291 | A1 | 7/2009 | Mikuriya et al. |
| 2009/0190949 | A1 | 7/2009 | Hamahashi et al. |
| 2009/0196638 | A1 | 8/2009 | Sukesako et al. |
| 2009/0238585 | A1 | 9/2009 | Hayashi et al. |
| 2009/0257792 | A1 | 10/2009 | Nakamura et al. |
| 2009/0279909 | A1 | 11/2009 | Matsushita et al. |
| 2009/0324270 | A1 | 12/2009 | Yamashita et al. |
| 2010/0009282 | A1 | 1/2010 | Katoh et al. |
| 2010/0055603 | A1 | 3/2010 | Nozaki et al. |
| 2010/0167196 | A1 | 7/2010 | Hagi et al. |
| 2010/0272481 | A1 | 10/2010 | Yamamoto et al. |
| 2010/0296848 | A1 | 11/2010 | Yamamoto et al. |
| 2011/0008069 | A1 | 1/2011 | Matsushita et al. |
| 2011/0013939 | A1 | 1/2011 | Ono |
| 2011/0217653 | A1 | 9/2011 | Izutani et al. |
| 2011/0243616 | A1 | 10/2011 | Nakagawa et al. |
| 2011/0249994 | A1 | 10/2011 | Matsushita et al. |
| 2012/0237270 | A1 | 9/2012 | Juri et al. |
| 2012/0294657 | A1 | 11/2012 | Matsushita et al. |
| 2012/0315067 | A1 | 12/2012 | Takahashi |
| 2013/0058685 | A1 | 3/2013 | Juri et al. |
| 2014/0212184 | A1 | 7/2014 | Juri et al. |
| 2014/0243465 | A1 | 8/2014 | Matsushita et al. |
| 2014/0321888 | A1 | 10/2014 | Yasunaga et al. |
| 2015/0014602 | A1 | 1/2015 | Matsushita et al. |
| 2015/0078777 | A1 | 3/2015 | Juri et al. |
| 2015/0078790 | A1 | 3/2015 | Ishikawa et al. |
| 2015/0078791 | A1 | 3/2015 | Momose et al. |

FOREIGN PATENT DOCUMENTS

| | | |
|---|---|---|
| JP | 4-255332 | 9/1992 |
| JP | 2005-164674 | 6/2005 |
| JP | 2011-180206 | 9/2011 |

OTHER PUBLICATIONS

May 6, 2016 European Search Report in corresponding European Patent Application No. EP 16150672.0.

* cited by examiner

SEMICONDUCTIVE RESIN COMPOSITION, MEMBER FOR ELECTROPHOTOGRAPHY AND IMAGE FORMING APPARATUS

CROSS-REFERENCE TO RELATED APPLICATIONS

This patent application is based on and claims priority pursuant to 35 U.S.C. § 119 to Japanese Patent Applications Nos. 2015-003181, 2015-051431 and 2015-174678, filed on Jan. 9, 2015, Mar. 13, 2015 and Sep. 4, 2015, respectively in the Japan Patent Office, the entire disclosure of which is hereby incorporated by reference herein.

BACKGROUND

Technical Field

The present invention relates to a semiconductive resin composition, a member for electrophotography and an image forming apparatus.

Description of the Related Art

As one of members for electrophotography for use in an electrophotographic image forming apparatus, an intermediate transfer belt formed of a semiconductive resin is known. Recently, image forming apparatuses have been required to have lower cost, and the intermediate transfer belt is required to have lower cost as well. At the same time, the intermediate transfer belt needs to ensure image quality and durability.

However, it has been difficult to control resistance in a semiconductive area while maintaining mechanical properties and durability in variation of environment. Particularly, although extrusion molding with a thermoplastic resin is advantageous to cost reduction because of being capable of producing continuously, resistance deviation in a circumferential direction of the belt due to the die tends to be large.

SUMMARY

A semiconductive resin composition includes at least two thermoplastic resins; and a conductive filler. Each of the two thermoplastic resins has a sea-island structure, and 40% to 75% of the conductive filler are present in the thermoplastic resin in an island portion of the sea-island structure at an areal ratio of a cross section observed with a scanning electron microscope.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
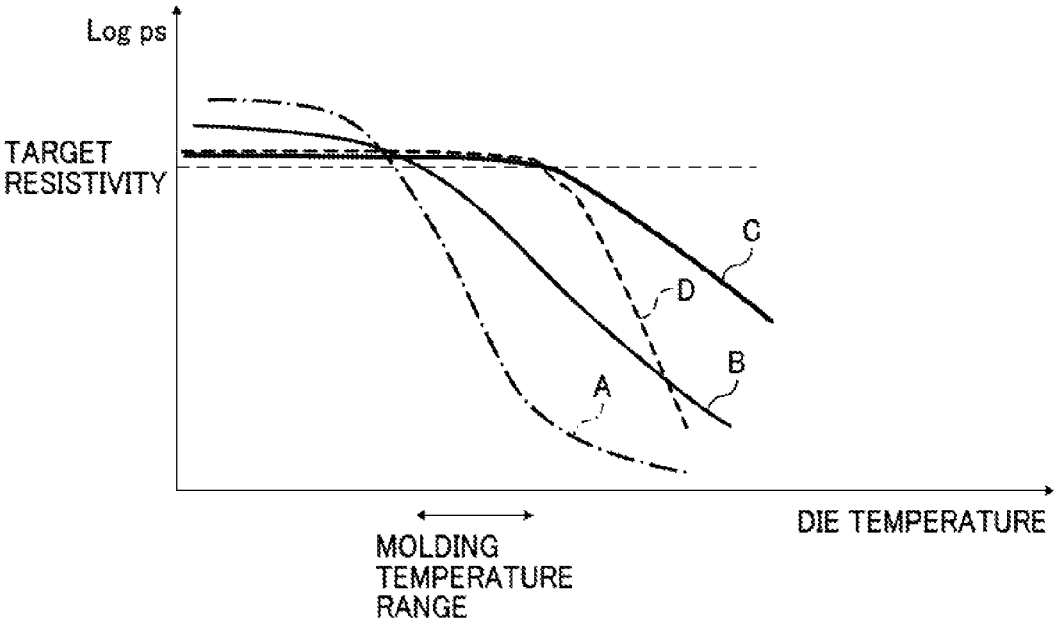
FIG. 1 is a diagram for explaining variation of resistance properties.

The present invention provides a semiconductive resin composition capable of reducing resistance deviation in a circumferential direction at low cost.

More particularly, the present invention relates to a semiconductive resin composition, including at least two thermoplastic resins; and a conductive filler, wherein each of the two thermoplastic resins has a sea-island structure, and 40% to 75% of the conductive filler are present in the thermoplastic resin in an island portion of the sea-island structure at an areal ratio of a cross section observed with a scanning electron microscope.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The semiconductive resin composition of the present invention has a surface resistivity of from $1\times10^{7}$ to $1\times10^{13}\Omega/\square$ when applied with 500 V for 10 sec.

The semiconductive resin composition of the present invention is preferably used for electrophotographic members such as an intermediate transfer belt, which is preferably a seamless belt.

The semiconductive resin composition of the present invention includes at least two thermoplastic resins and a conductive filler. The two thermoplastic resins have a sea-island structure, and 40% to 75% of the conductive filler are present in the thermoplastic resin in an island portion of the sea-island structure at an areal ratio. Such an abundance ratio of the conductive filler decreases variation of resistance regardless of molding temperature.

Since the two thermoplastic resins have a sea-island structure, a sea portion thereof is constituted of a resin forming a substrate of the semiconductive resin composition. On the other hand, an island portion thereof is preferably constituted of a resin having high conductivity.

The abundance ratio of the conductive filler present in the thermoplastic resin in an island portion of the sea-island structure is from 40% to 75%, and preferably from 50% to 70% at an areal ratio. This range can further reduce the resistance deviation.

The abundance ratio of the conductive filler present in the island portion is determined by photographing a cross section of a sample with a scanning electron microscope (SEM) to calculate a ratio of an area of the conductive filler present in the island portion to an area thereof in both of the sea and island portions.

<Resistance Properties>

FIG. 1 is a diagram for explaining resistance properties. FIG. 1 is a diagram showing variation of resistance properties of various samples according to molding temperature. In FIG. 1, a horizontal axis is temperature of a die used for molding the semiconductive resin composition, and a vertical axis is a common logarithm value of the surface resistivity of the semiconductive resin composition (hereinafter referred to as "resistance").

In FIG. 1, "resistance target value" is 11, and a "molding temperature range" is a die temperature when molding the semiconductive resin composition. A width of the process temperature represents unevenness of the molding temperature.

A in FIG. 1 is an example of resistance variation of the semiconductive resin composition formed of only a substrate resin and a conductive filler without a sea-island structure. In an area where a molding temperature is low, i.e., at a temperature lower than a molding temperature range, the surface resistivity (Log) is about from 12 to 13 and varies less regardless of a temperature.

However, when the temperature is increased, the resistivity quickly lowers around the molding temperature range as shown in FIG. 1. It is thought this is because the conductive filler aggregates to lower the resistivity when the molding temperature increased. Occasionally, an intermediate transfer belt is required to have a surface resistivity (Log) of 11, but the belt has a large resistance variation relative to the molding temperature. Namely, an intermediate transfer belt having a surface resistivity (Log) of 11 has a large resistance deviation.

B in FIG. 1 is a resistance variation of the semiconductive resin composition having a sea-island structure and the conductive filler present in an island portion is less than 40% of the total conductive fillers. B in FIG. 1 is an example in which a resin having high conductivity forms the island portion. In an area where the molding temperature is low, i.e., the resistivity is lower than A in a temperature range lower than the molding temperature range. Namely, the resistivity is close to a resistance target value. However, although the resistance variation is smaller than A in the molding temperature range, the resistance variation, i.e., the resistance deviation is not sufficiently suppressed.

C in FIG. 1 is a resistance variation of the semiconductive resin composition having a sea-island structure and the conductive filler present in an island portion is from 40% to 75% of the total conductive fillers. In an area where the molding temperature is low, i.e., the resistivity is further lower than B in a temperature range lower than the molding temperature range. Namely, the resistivity is closer to a resistance target value than A or B. In addition, the surface resistivity (Log) is stably 11 in the molding temperature range. Further, quick resistance variation decreases even when the temperature is higher than the molding temperature range.

It is thought this is because the conductive filler included in the island portion decreases resistance thereof and a low temperature range having less resistance variation decreases in resistance. According to C in FIG. 1, the resistance variation can be reduced to further suppress the resistance deviation.

D in FIG. 1 is a resistance variation of the semiconductive resin composition having a sea-island structure and the conductive filler present in an island portion is not less than 80% of the total conductive fillers. In an area where the molding temperature is low, i.e., the resistivity is larger than C in a temperature range lower than the molding temperature range.

It is thought this is because most of the conductive filler are present in the island portion and the conductive filler in the sea portion decreases, resulting in lowering of the conductivity between the islands.

Therefore, in a temperature range lower than the molding temperature range or the molding temperature range, the resistivity is out of the resistance target value more than C.

D in FIG. 1 more quickly decreases and varies in resistance than C in a temperature range higher than the molding temperature range, resulting in large resistance deviation. D is more unpreferable than C because of having large resistance deviation when the molding temperature is high.

<Thermoplastic Resin>

Two thermoplastic resins have sea-island structures, and therefore the sea portion is constituted of a resin forming a substrate of the semiconductive resin composition. Meanwhile, the island portion is preferably constituted of a resin having high electroconductivity. In the present invention, the contents of the sea and the island portions are changeable when necessary, e.g., the content of the resin in the island portion is preferably from 3% to 15% by weight based on total weight of the resin.

<<Resin in Sea Portion>>

The resin in the sea portion forms a substrate of the semiconductive resin composition, and known thermoplastic resins can be used therefor such as polyvinylidene fluoride (PVDF) resins, polyethylene resins, polypropylene resins, polystyrene resins, thermoplastic polyamide (PA) resins, acrylonitrile-butadiene-styrene (ABS) resins, thermoplastic polyacetal (POM) resins, thermoplastic polyarylate (PAR) resins, thermoplastic polycarbonate (PC) resins, thermoplastic urethane resins, polyethylene naphthalate (PEN) resins, polybutylene naphthalate (PBN) resin, polyalkylene terephthalate resin and polyester-based resin, etc. Among these, resins having high elasticity, high fold resistance and incombustibility are preferably used. Particularly, polyvinylidene fluoride (PVDF) resin is preferably used.

<<Resin in Island Portion>>

Known thermoplastic resins can be used as the resin in the island portion, and the resin in the sea portion can be used as well. The resin in the island portion preferably has high electroconductivity, and a known polymeric antistat can be used therein. Specific examples of the polymeric antistat include known materials such as polyether-ester amides, ethylene oxide-epichlorohydrins, polyether esters and polystyrene sulfonates. Particularly, a block copolymer having a polyalkylene unit is preferably used.

<<Properties>>

—Crystallization Temperature—

The thermoplastic resin in the sea portion preferably has a crystallization temperature (Tc1) lower than a crystallization temperature (Tc2) of the island portion (Tc1<Tc2). A value obtained by subtracting Tc1 from Tc2 is preferably not less than 5° C. ($Tc2-Tc1 \geq 5$). This is advantageous to decrease unevenness of the surface resistivity because the conductive filler unevenly distributed in the thermoplastic resin in the island portion is difficult to aggregate. The crystallization temperature can be measured by. e.g., a differential scanning calorimeter (DSC) Q2000 from TA Instruments.

—Surface Free Energy—

A value ($\gamma2-\gamma1$) obtained by subtracting a surface free energy ($\gamma1$) of the thermoplastic resin in the sea portion from a surface free energy ($\gamma2$) of the thermoplastic resin in the island portion not less than 30 $mJ/m^2$. This is advantageous to decrease unevenness of the surface resistivity. The surface free energy can be measured by a typical contact angle measurer such as an automatic contact angle meter DM-701 from Kyowa Interface Science Co., LTD. The thermoplastic resin is modified to have the shape of a plate. A droplet of three solvents, i.e., water, diodomethane and ethylene glycol is dropped on the plate to measure a contact angle. A software provided with the apparatus is used to determine a surface free energy of the thermoplastic resin.

—Bleed Rate to Distilled Water—

A bleed rate of the thermoplastic resin in the island portion to distilled water is preferably not greater than 4%. With a preferred range of the bleed rate, when an intermediate transfer belt is formed with a resin composition, bleed influence of an image bearer contacting the intermediate transfer belt is decreased to maintain image quality.

The bleed rate is measured by the following method. First, the thermoplastic resin in the island portion (weight A) and distilled water (weight B) are contained in a glass container. The glass container is sealed and dried for 1 hr by a drier at 45° C. The dried glass container is oscillated by an ultrasonic oscillation generator for 40 min, and dried again for 8 hrs by the drier at 45° C. Distilled water extraction liquid (weight D) in the glass container taken out from the drier is put in a glass petri dish (weight c). In order to evaporate moisture of the distilled water extraction liquid to precipitate a solid content, the petri dish is dried by a drier for 3 hrs at 105° C. Then, the petri dish is taken out from the drier and cooled for 1 hr by air, and measured (weight E). Weights A to E are measured by a precision balance. The bleed rate to the distilled water is determined by the following formula.

$$\text{The bleed rate to distilled water (\%)}=((E-C)/((A/B)\times D))\times 100$$

—Surface Specific Resistivity—

The thermoplastic resin in the island portion preferably has a surface specific resistivity not greater than $5\times10^7\Omega/\square$, which reduces the content of the conductive filler and suppresses aggregation thereof to decrease uneven surface resistivity. When the bleed rate is the same, it is preferable the surface specific resistivity is low because it is easy to balance the uneven surface resistivity and the bleed rate.

The surface specific resistivity is measured, e.g., according to ASTM D257.

<Conductive Filler>

Metal oxides, carbon black and known conductive fillers can be used as the conductive filler. Specific examples of the metal oxides include zinc oxide, tin oxide, titanium oxide, zirconium oxide, aluminum oxide, silicon oxide, etc. In addition, the above metal oxide subjected to surface treatment beforehand is used to improve dispersibility.

Among the conductive fillers, carbon black is preferably used.

Specific examples of the carbon black include KETJEN BLACK, channel black, furnace black, acetylene black, thermal black, gas black, graphite, carbon nanotube, etc. Among these, acetylene black is preferably used.

Oxidized carbon blacks for various applications available from manufacturers can be used in the present invention.

Coupling agents having a functional group reactable with a functional group on the surface of the carbon black may be applied thereto to control basicity or acidity.

Carbon black preferably has an average primary particle diameter of from 10 nm to 40 nm, which decreases resistance variation relative to a molding temperature. The average primary particle diameter of carbon black is measured by observing carbon black particles with a known electron microscope to determine an arithmetic average diameter.

Carbon black preferably has a DBP oil absorption not greater than 200 $cm^3$/100 g, which improves dispersibility of the carbon black in a resin to decrease resistance variation relative to a molding temperature. The DBP oil absorption is an amount of DBP (dibutyl phthalate) absorbed in 100 g of carbon black, and is measured according to JIS K6221.

Carbon black preferably has a pH not less than 9, which decreases resistance variation relative to a molding temperature. It is thought this is because dispersibility of the carbon black in a resin is improved. pH is determined by measuring a mixed liquid including carbon black and distilled water with a pH meter.

<Method of Preparing the Semiconductive Resin Composition>

Specific examples of a method of preparing the semiconductive resin composition of the present invention include, but are not limited to, melting and kneading a thermoplastic resin and an conductive filler to disperse the conductive filler in the resin, and extrusion-molding them. Methods of melting, kneading and molding are explained.

<<Methods of Melting and Kneading>>

Specific examples of the melting and kneading apparatus include, but are not limited to, any known kneaders, e.g., biaxial kneaders such as KTK from Kobe Steel, Ltd., TEM from Toshiba Machine Co., Ltd., TEX from Japan Steel Works, Ltd., PCM from Ikegai Co., Ltd. and KEX from Kurimoto Ltd.; and monoaxial kneaders such as KO-KNEADER from Buss Corporation.

The kneaded materials are processed by a pelletizer to a pellet.

The dispersion status of the conductive filler changes according to the dispersion conditions. As mentioned above, in the present invention, an amount of the conductive filler present in a resin in the island portion needs to be 40% to 75% of the total amount of the conductive filler at an areal ratio to decrease resistance variation relative to a molding temperature.

The dispersibility of the conductive filler in the resin of the sea portion may be different from that in the resin of the island portion. When all the materials are put in once, the conductive filler may unevenly be distributed in either of the resins and an amount thereof may be uncontrollable.

In order to avoid such uneven distribution, the conductive filler may be separately kneaded with each of the resins to prepare pellets, and the pellets may be mixed together. Namely, a process of melting and kneading the thermoplastic resin constituting the sea portion of the sea-island structure and the conductive filler to prepare a pellet A, a process of melting and kneading the thermoplastic resin constituting the island portion of the sea-island structure and the conductive filler to prepare a pellet B, and a process of melting and kneading the pellets A and B to be extrusion-molded may be combined. In the present invention, an abundance ratio of the conductive filler in the island portion is from 40% to 75%. However, this may be unrealizable due to affinity of the filler with the sea portion and the island portion resins. This kneading order can realize the abundance ratio while a normal mixing order cannot.

The pellet A and the pellet B are separately prepared, and finally they are melted and kneaded together.

<<Molding Method>>

After melted and kneaded as mentioned above, the kneaded mixture is processed by a molding processor to have a desired shape. Known molding processors can be used as the molding processor for use in the present invention. For example, an extrusion molder can mold a cylindrical member such as intermediate transfer belts.

Figure 2:
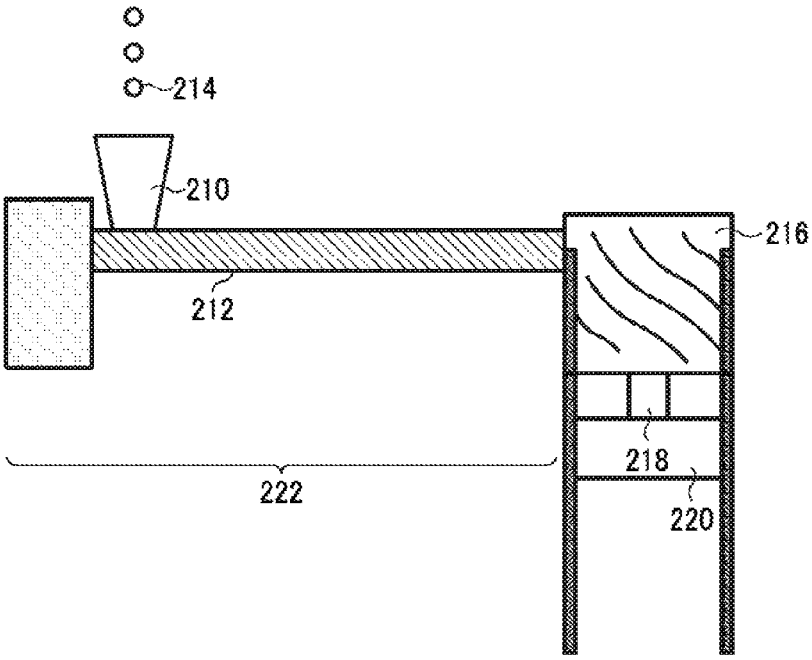
FIG. 2 is a schematic view illustrating an example of extruder.

FIG. 2 is a schematic view illustrating an embodiment of the extrusion molder. The extrusion molder in FIG. 3 includes a hopper 210, a screw 212, a compound 214, a mandrel die 216, an inner core (sizing die) 220 and an extruder 222.

An example of the molding method is explained. The compound 214 is put from the hopper 210, and the temperature of the screw 212 is adjusted such that a resin is sufficiently fed into the mandrel die 216. A cylindrical film is extruded from the die when the temperature of the die is higher than a melting point of the thermoplastic resin. The extruded resin is cooled by the sizing die 220. The cylindrical film is drawn with an inner and outer rollers.

The melted resin extruded from the extruder 222 is poured into the cylindrical the mandrel die 216 to prepare a seamless belt. The resin extruded from the extruder 222 may be poured into a spiral die in which flow paths are divided into 8 and join together to spirally flow the resin. Besides, a coat hanger die in which flow paths are not divided and the resin moves round and joins at one point can be used. Then, the resin flows out from a lip. The belt is molded through the inner core to decide a peripheral length and a shape thereof and drawn while put between rollers.

(Image Forming Apparatus)

The image forming apparatus of the present invention includes at least an electrostatic latent image bearer (hereinafter referred to as a "photoconductor"), an electrostatic latent image former, an image developer and a transferer, and other means when necessary. The image forming apparatus of the present invention includes the member for electrophotography of the present invention. The member for electrophotography is an intermediate transfer belt, and the transfer preferably includes the intermediate transfer belt.

The image forming method of the present invention includes at least an electrostatic latent image forming process, a developing process and a transferer process, and other processes when necessary.

The image forming method of the present invention uses the member for electrophotography of the present invention. The member for electrophotography is an intermediate transfer belt, and the transfer process preferably uses the intermediate transfer belt.

The image forming method can preferably be executed by the image forming apparatus of the present invention, the electrostatic latent image forming process can preferably be executed by the electrostatic latent image former, the developing process can preferably be executed by the image developer, and the other processes can preferably be executed by the other means.

<Electrostatic Latent Image Former>

The electrostatic latent image former is not particularly limited in materials, structures and sizes, and can be selected from known inorganic photoconductors such as amorphous silicon and selenium, or an organic photoconductors such as polysilane or phthalopolymethine. Amorphous silicon is preferably used terms of long lifespan.

The amorphous silicon photoconductor is formed by heating a substrate at from 50° C. to 400° C. and forming an a-Si photosensitive layer on the substrate by film forming methods such as a vacuum deposition method, a sputtering method, an ion plating method, a heat CVD (Chemical Vapor Deposition) method, a photo CVD method an a plasma CVD method. Particularly, the plasma CVD method is preferably used, which forms an a-Si layer on the substrate by decomposing a gas material with a DC, a high-frequency or a microwave glow discharge.

The electrostatic latent image former is not particularly limited in shape, but preferably has the shape of a cylinder. The cylindrical electrostatic latent image former is not particularly limited in outer diameter, and preferably has an outer diameter of from 3 mm to 100 mm, more preferably from 5 mm to 50 mm, and most preferably from 10 to 30 mm.

<Electrostatic Latent Image Former and Electrostatic Latent Image Forming Process>

The electrostatic latent image former is not particularly limited if it forms an electrostatic latent image on the electrostatic latent image bearer, and includes, e.g., a charger charging the surface of the electrostatic latent image bearer and an irradiator irradiating the surface thereof with imagewise light.

The electrostatic latent image forming process is not particularly limited if it is a process of forming an electrostatic latent image on the electrostatic latent image bearer, and includes, e.g., charging the surface of the electrostatic latent image bearer and irradiating the surface thereof with imagewise light with the electrostatic latent image former.

—Charger and Charging Process—

Specific examples of the charger include, but are not limited to, a contact charger equipped with a conductive or semiconductive roller, brush, film, or rubber blade, and a non-contact charger employing corona discharge such as corotron and scorotron.

The charging process is executed by the charger applying a voltage to the surface thereof.

The charger may have the shape of a magnetic brush or a fur brush besides a roller according to the specification and configuration of the image forming apparatus.

The magnetic brush is formed of various ferrite particles such as Zn—Cu ferrite as a charging member, a non-magnetic conductive sleeve and a magnet roll included thereby.

The fur brush is formed of a metallic core wound by a conductive fur with carbon, copper sulfate, metals or metal oxides.

The charger is not limited to the contact charger, but is preferably used because of generating less ozone.

—Irradiator and Irradiation Process—

The irradiator is not particularly limited if it irradiates the charged surface of the electrostatic latent image bearer with imagewise light. Specific examples of the irradiator include, but are not limited to, various irradiators of radiation optical system type, rod lens array type, laser optical type, and liquid crystal shutter optical type.

Specific examples of light sources for use in the irradiator include, but are not limited to, those providing a high luminance, such as light-emitting diode (LED), laser diode (LD), and electroluminescence (EL).

In order to irradiate the electrostatic latent image bearer with light having a wavelength in a desired range, sharp cut filters, bandpass filters, infrared cut filers, dichroic filters, interference filters, color temperature converting filters, and the like can be used.

The irradiation process is executed by the irradiator irradiating the surface of the electrostatic latent image bearer with imagewise light.

In the present invention, it is possible to irradiate the electrostatic latent image bearer from the backside thereof.

<Image Developer and Developing Process>

The image developer is not particularly limited if it develops the electrostatic latent image formed on the electrostatic latent image bearer with a toner to form a visible image.

The developing process is not particularly limited if it is a process of developing the electrostatic latent image formed on the electrostatic latent image bearer with a toner to form a visible image with the image developer.

The image developer may employ either a dry developing method or a wet developing method. The image developer may employ either a single-color image developer or a multi-color image developer. For example, an image developer which has a stirrer for frictionally charging the developer and a rotatable magnet roller is preferable.

In the image developer, toner particles and carrier particles are mixed and stirred, and the toner particles are charged by friction. The charged toner particles and carrier particles are formed into ear-like aggregation and retained on the surface of the magnet roller that is rotating, thus forming a magnetic brush. Because the magnet roller is disposed adjacent to the electrostatic latent image bearer, a part of the toner particles composing the magnetic brush formed on the surface of the magnet roller migrate to the surface of the electrostatic latent image bearer by an electric attractive force. As a result, the electrostatic latent image is developed with the toner particles to form a visible image on the surface of the electrostatic latent image bearer.

<Transferer and Transfer Process>

The transferer is not particularly limited if it transfers the visible image onto a recording medium, and preferably includes a first transferer transferring the visible image onto an intermediate transferer to form a complex transfer image and a second transferer transferring the complex transfer image onto a recording medium.

The transfer process is not particularly limited if it is a process of transferring the visible image onto a recording medium, and preferably includes firstly transferring the visible image onto an intermediate transferer to form a complex transfer image and secondly transferring the complex transfer image onto a recording medium.

The transfer process is executed by the transferer using a transfer charger charging the photoconductor.

When an image second transferred onto the recording medium is a colored image formed of toners of plural colors, the transferer sequentially overlaps each color toner on the intermediate transferer to form an image, and the intermediate transferer second transfers the image on the recording medium once. Specific examples of the intermediate transferer includes, but are not limited to, an intermediate transfer belt. The member for electrophotography of the present invention is preferably used as the intermediate transfer belt.

The transferer (each of the first transferer and the second transferer) preferably has at least a transfer unit separating and charging the visible image formed on the photoconductor to the side of the recording medium.

Specific examples of the transfer unit include a corona transferer discharging corona, a transfer belt, a transfer roller, a pressure transfer roller, an adhesive transfer unit, etc.

Specific examples of the recording medium typically include, but are not limited to, plain papers if an unfixed image after developed can be transferred to. PET for OHP can also be used.

<Other Means and Other Processes>

The other means include a fixer, a cleaner, a discharger, a recycler, a controller, etc. The other processes include a fixing process, a cleaning process, a discharge process, a recycle process, a control process, etc.

—Fixer and Fixing Process—

The fixer is not particularly limited and can be selected according to the purpose, and known heating and pressing means is preferably used. The heating and pressing means includes a combination of a heat roller and a pressure roller, a combination of a heat roller, a pressure roller and an endless belt.

The fixing process fixes a toner image transferred onto the recording medium, and may fix each toner (visible) image transferred thereon or layered toner images of each color at one time.

The heating and pressing means preferably heats at 80° C. to 200° C.

The fixer may be an optical fixer, and this can be used alone or in combination with the heating and pressing means.

A surface pressure in the fixing process is preferably from 10 $N/cm^2$ to 80 $N/cm^2$.

—Cleaner and Cleaning Process—

The cleaner is not limited in configuration so long as it can remove residual toner particles remaining on the electrophotographic photoconductor. Specific examples of the cleaner include, but are not limited to, magnetic brush cleaner, electrostatic brush cleaner, magnetic roller cleaner, blade cleaner, brush cleaner, and web cleaner.

The cleaning process can be performed by the cleaner, and is a process of removing residual toner particles remaining on the electrophotographic photoconductor.

—Neutralizer and Neutralization Process—

The neutralizer is not limited in configuration so long as it can apply a neutralization bias to the electrophotographic photoconductor. Specific examples of the neutralizer include, but are not limited to, a neutralization lamp.

The neutralization process can be performed by the neutralizer, and is a process of neutralizing the electrophotographic photoconductor by application of a neutralization bias thereto.

—Recycler and Recycle Process—

Specific examples of the recycler include, but are not limited to, a conveyer if it recycles the toner removed in the cleaning process in the image developer.

The recycle process can be performed by the recycler, and is a process of recycling the toner particles removed in the cleaning process in the image developer.

—Controller and Control Process—

The controller is not limited in configuration so long as it can control the above-described processes. Specific examples of the controller include, but are not limited to, a sequencer and a computer.

The control process can be performed by the controller, and is a process of controlling the above-described processes.

Figure 3:
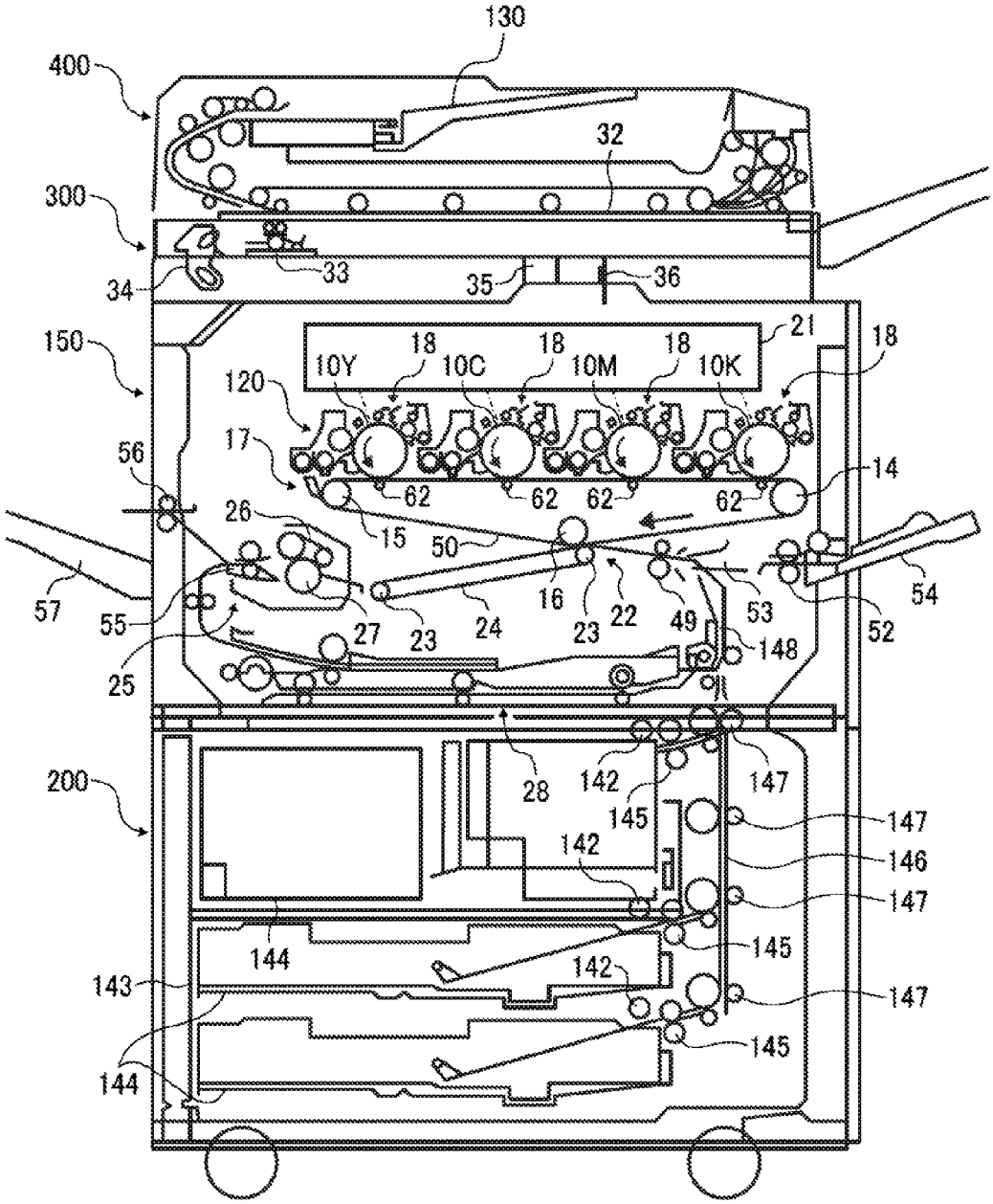
FIG. 3 is a schematic view illustrating an embodiment of the image forming apparatus of the present invention.
Figure 4:
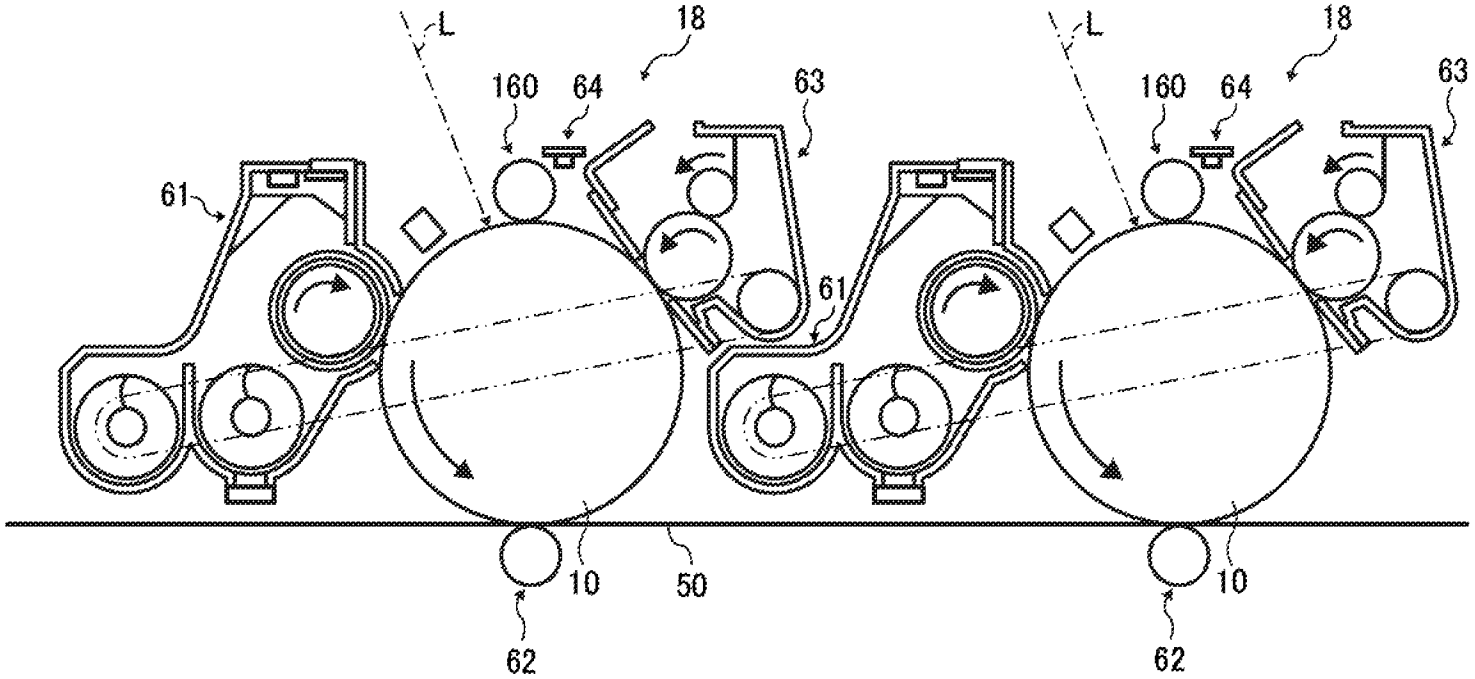
FIG. 4 is a schematic view illustrating another embodiment of the image forming apparatus of the present invention.

An embodiment of the image forming apparatus of the present invention is explained, referring to FIGS. 3 and 4.

An image forming apparatus in FIG. 3 includes a main body 150, a paper feed table 200, a scanner 300, and an automatic document feeder (ADF) 400.

A seamless-belt shaped intermediate transferer 50 is disposed at the center of the main body 150. The intermediate transferer 50 is stretched taut with support rollers 14, 15, and 16 and is rotatable clockwise in FIG. 3. A cleaner 17 is disposed adjacent to the support roller 15 to remove residual toner particles remaining on the intermediate transferer 50. Four image forming units 18 adapted to form respective toner images of yellow, cyan, magenta, and cyan are disposed in tandem facing a surface of the intermediate transferer 50 stretched between the support rollers 14 and 15. The image forming units 18 forms a tandem image developer 120.

An irradiator 21 is disposed adjacent to the tandem image developer 120. A second transferer 22 is disposed on the opposite side of the tandem developing device 120 with respect to the intermediate transferer 50. The second transferer 22 includes a seamless secondary transfer belt 24 stretched taut with a pair of rollers 23. The second transferer 22 is configured such that the secondary transfer belt 24 conveys a recording medium while keeping the recording medium contacting the intermediate transferer 50. A fixer 25 is disposed adjacent to the second transferer 22. The fixer 25 includes a seamless fixing belt 26 and a pressing roller 27 pressed against the fixing belt 26.

A reverser 28 adapted to reverse recording medium in duplexing is disposed adjacent to the second transferer 22 and the fixing device 25.

Next, full-color image formation (color copy) using the tandem image developer 120 is explained. A document is set on a document table 130 of the automatic document feeder 400. Alternatively, a document is set on a contact glass 32 of the scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. The light is then received by a reading sensor 36. Thus, the document is read and image information of black, cyan, magenta, and yellow are obtained.

Then, each image information of black, yellow, magenta, and cyan is transmitted to corresponding image forming units 18 (black image forming unit, yellow image forming unit, magenta image forming unit, and cyan image forming unit) in the tandem type developing unit 120 to form each toner image of black, yellow, magenta, and cyan in each image forming unit.

Specifically, as illustrated in FIG. 4, each image forming unit 18 (black image forming unit, yellow image forming unit, magenta image forming unit, and cyan image forming unit) in the tandem type developing unit 120 has a latent electrostatic image bearing member 10 (black latent electrostatic image bearing member 10K, yellow latent electrostatic image bearing member 10Y, magenta latent electrostatic image bearing member 10M, and cyan latent electrostatic image bearing member 10C, a charger 60 that uniformly charges the latent electrostatic bearing member 10, an irradiator that exposes the latent electrostatic image bearing member 10 with L illustrated in FIG. 4 according to the color image information to form a latent electrostatic image corresponding to each color image on the latent electrostatic image bearing member 10, a developing unit 61 that develops the latent electrostatic image by using each color toner (black toner, yellow toner, magenta toner, and cyan toner) to form a toner image of each color toner, a transfer charger 62 that transfers the toner image to the intermediate transferer 50, a cleaning device 63, and a discharger 64, to form each single color image (black image, yellow image, magenta image, and cyan image) based on each color image formation.

The black image, yellow image, magenta image, and cyan image formed in this manner, that is, the black image formed on the black latent electrostatic image carrier 10K, yellow image formed the yellow latent electrostatic image carrier 10Y, magenta image formed on the magenta latent electrostatic image bearing member 10M, and cyan image formed on the cyan latent electrostatic image bearing member 10C are transferred (primary transfer) one by one to the intermediate transferer 50 which is rotationally transferred by the support rollers 14, 15, and 16. Then, the black image, yellow image, magenta image, and cyan image are superimposed sequentially on the intermediate transferer 50 to form a synthetic color image (color transfer image).

In the paper feeding table 200, one of the paper feed rollers 142 is selectively rotated to draw a recording medium from one of multistage paper feed cassettes 144 provided in a paper bank 143. A separating roller 145 separates the recording media one by one by to feed each paper to a paper feed path 146. The recording medium is conveyed by a conveyer roller 147, introduced into a paper feed path 148 in the main body 150, strikes a registration roller 49, and is held there. Alternatively, the recording medium on a manual tray 54 is fed one by one by a separating roller 52, introduced into a manual paper feed path 53, strikes a registration roller 49, and is held there. Although the registration roller 49 is usually used in a grounded condition, a bias can be applied thereto to remove paper dust of the recording medium.

Then, the registration roller 49 feeds the recording medium between the intermediate transferer 50 and the second transferer 22 by rotating in synchronization with the synthetic color image (color transfer image) synthesized on the intermediate transferer 50. The second transferer 22 secondly transfers the synthetic color image (color transfer image) to the recording medium to form the color image thereon. Residual toner left on the intermediate transferer 50 after the image transfer is removed by the intermediate transferer cleaner 17.

The recording medium onto which the color image is transferred is conveyed by the second transferer 22 and fed to a fixer 25 including a fixing belt 26 and pressure roller 27, where the synthetic color image (color transfer image) is fixed onto the recording medium by heat and pressure. Then, the recording medium is turned by a switching claw 55, discharged by a discharge roller 56, and stuck on a paper discharge tray 57. Alternatively, the recording medium is turned by the switching claw 55, inversed by the reverser 28, introduced again into the transfer position to record an image on the backside thereof, then, discharged by the discharge roller 56, and stuck on the discharge tray 57.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example A1

A seamless belt was prepared by the following method with the following materials.

<Materials>

- Thermoplastic Resin 1 (Sea Portion Resin): Polyvinylidene fluoride (Kynar 720 from Arkema)
- Thermoplastic Resin 2 (Island Portion Resin): Polyether ester amide (PELECTRON AS from Sanyo Chemical Industries, Ltd.).
- Conductive filler: Furnace black (#3030B from Mitsubishi Chemical Corp.)

<Kneading Conditions>

Eighty-five (85) parts of the thermoplastic resin 1, 8 parts of the thermoplastic resin 2 and 7 parts of the conductive filler were placed in HENSCHEL MIXER SPM from KAWATA MFG Co., Ltd. and stirred therein to prepare a powder in which the materials were mixed. Next, the powder was melted and kneaded by a biaxial kneader TEM from Toshiba Machine Co., Ltd., and pelletized to prepare a pellet. Further, the pellet was kneaded twice by the biaxial kneader to prepare a pellet A1-1. Next, the pellet A1-1 was placed in a cylindrical die for melting, kneading and extrusion molding to prepare a seamless belt A having a circumferential length of 960 mm and a thickness of 120 μm.

<Evaluation of Belt Properties>

Thirty-two (32) points of the seamless belt A at an interval of 30 mm in a circumferential direction were measured by under an environment of 23° C. and 50% with a resistance measurer (HIRESTA URS probe from Mitsubishi Chemical Analytech Co., Ltd.) and calculated P—P (the maximum–minimum of Log (resistivity) as a deviation. When the resistance deviation is not less than 1, the seamless belt as a transfer belt for electrophotography is difficult to first transfer or second transfer at a high resistivity portion, resulting in defective images.

Example A2

The procedures for preparation and evaluation of the seamless belt A in Example A1 were repeated except for changing the materials and the kneading conditions as follows to prepare a seamless belt B having a circumferential length of 960 mm and a thickness of 120 μm.

<Materials>

Thermoplastic Resin 1 (Sea Portion Resin): Polyvinylidene fluoride (Kynar 721 from Arkema)

Thermoplastic Resin 2 (Island Portion Resin): Polyether ester amide (PELECTRON AS from Sanyo Chemical Industries, Ltd.).

Conductive filler: Toka black (#4400 from Tokai Carbon Co., Ltd.)

<Kneading Conditions>

—Kneading 1—

Ninety-two point five (92.5) parts of the thermoplastic resin 1 (Sea Portion Resin) and 7.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet A2-1.

—Kneading 2—

Ninety-nine point five (99.5) parts of the thermoplastic resin 2 (Island Portion Resin) and 0.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet A2-2.

—Kneading 3—

Ninety-two (92) parts of the pellet A2-1 and 8 parts of the pellet A2-2 were melted and kneaded once by a biaxial kneader TEM from Toshiba Machine Co., Ltd., and pelletized to prepare a pellet A2-3.

—Molding—

The pellet A2-3 was placed in a cylindrical die for melting, kneading and extrusion molding to prepare the seamless belt B.

Example A3

The procedures for preparation and evaluation of the seamless belt A in Example A1 were repeated except for replacing the conductive filler with KETJEN BLACK EC300J from Lion Corp. to prepare a pellet A3-1 and a seamless belt C having a circumferential length of 960 mm and a thickness of 120 μm.

Example A4

The procedures for preparation and evaluation of the seamless belt A in Example A1 were repeated except for replacing the conductive filler with acetylene black (granulated DENKA BLACK from Denka Company Limited) to prepare a pellet A4-1 and a seamless belt D having a circumferential length of 960 mm and a thickness of 120 μm.

Example A5

The procedures for preparation and evaluation of the seamless belt D in Example A4 were repeated except for changing the kneading conditions as follows to prepare a pellet A5-3 and a seamless belt E having a circumferential length of 960 mm and a thickness of 120 μm.

<Kneading Conditions>

—Kneading 1—

Ninety-two point five (92.5) parts of the thermoplastic resin 1 (Sea Portion Resin) and 7.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet A5-1.

—Kneading 2—

Ninety-nine point five (99.5) parts of the thermoplastic resin 2 (Island Portion Resin) and 0.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet A5-2.

—Kneading 3—

Ninety-two (92) parts of the pellet A5-1 and 8 parts of the pellet A5-2 were melted and kneaded once by a biaxial kneader TEM from Toshiba Machine Co., Ltd., and pelletized to prepare the pellet A5-3.

Comparative Example A1

The procedures for preparation and evaluation of the seamless belt B in Example A2 were repeated except for changing the kneading conditions as follows to prepare a pellet A6-1 and a seamless belt F having a circumferential length of 960 mm and a thickness of 120 μm.

<Kneading Conditions>

Eighty-five (85) parts of the thermoplastic resin 1, 7 parts of the thermoplastic resin 2 and 6 parts of the conductive filler were placed in HENSCHEL MIXER SPM from KAWATA MFG Co., Ltd. and stirred therein to prepare a powder in which the materials were mixed. Next, the powder was melted and kneaded by a biaxial kneader TEM from Toshiba Machine Co., Ltd., and pelletized to prepare a pellet. Further, the pellet was kneaded twice by the biaxial kneader to prepare a pellet A6-1.

Comparative Example A2

The procedures for preparation and evaluation of the seamless belt D in Example A4 were repeated except for changing the kneading conditions as follows to prepare a pellet A7-2 and a seamless belt G having a circumferential length of 960 mm and a thickness of 120 μm.

<Kneading Conditions>

—Kneading 1—

Eighty-five (85) parts of the thermoplastic resin 1 (Sea Portion Resin) and 7 parts of the conductive filler were placed in HENSCHEL MIXER SPM from KAWATA MFG. Co., Ltd. and stirred therein to prepare a powder in which the materials were mixed. The powder was melted and kneaded once by a biaxial kneader TEM from Toshiba Machine Co., Ltd., and pelletized to prepare a pellet A7-1.

—Kneading 2—

Ninety-three (93) parts of the pellet A7-1, 7 parts of the thermoplastic resin 2 (Island Portion Resin) and 5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare the pellet A7-2.

(Abundance Ratio of Conductive Filler in Island Portion)

The abundance ratio of the conductive filler present in the island portion was measured by photographing a cross section of a sample with a scanning electron microscope (SEM) to calculate a ratio of an area of the conductive filler present in the island portion to an area thereof in both of the sea and island portions.

The compositions and the evaluation results of Examples and Comparative Examples are shown in Table 1.

TABLE 1

| | | | Composition Thermoplastic Resin | |
|---|---|---|---|---|
| | Belt | Pellet | Thermoplastic Resin 1 (Sea Portion resin) | Thermoplastic Resin 2 (Island Portion resin) |
| Example A1 | A | A1-1 | Polyvinylidene fluoride (Kynar 721 from Arkema) | Polyether ester amide (PELECTRON AS from Sanyo Chemical Industries, Ltd.). |
| Example A2 | B | A2-3 | Polyvinylidene fluoride (Kynar 721 from Arkema) | Polyether ester amide (PELECTRON AS from Sanyo Chemical Industries, Ltd.). |
| Example A3 | C | A3-1 | Polyvinylidene fluoride (Kynar 721 from Arkema) | Polyether ester amide (PELECTRON AS from Sanyo Chemical Industries, Ltd.). |
| Example A4 | D | A4-1 | Polyvinylidene fluoride (Kynar 721 from Arkema) | Polyether ester amide (PELECTRON AS from Sanyo Chemical Industries, Ltd.). |
| Example A5 | E | A5-3 | Polyvinylidene fluoride (Kynar 721 from Arkema) | Polyether ester amide (PELECTRON AS from Sanyo Chemical Industries, Ltd.). |
| Comparative Example A1 | F | A6-1 | Polyvinylidene fluoride (Kynar 721 from Arkema) | Polyether ester amide (PELECTRON AS from Sanyo Chemical Industries, Ltd.). |
| Comparative Example A2 | G | A7-2 | Polyvinylidene fluoride (Kynar 721 from Arkema) | Polyether ester amide (PELECTRON AS from Sanyo Chemical Industries, Ltd.). |

| | | | Composition Conductive Filler | | | |
|---|---|---|---|---|---|---|
| | Belt | Pellet | Name | pH | Average primary Particle Diameter (nm) | DBP Oil Absorption ($cm^3$/100 g) |
| Example A1 | A | A1-1 | Furnace black (#3030B from Mitsubishi Chemical Corp.) | 6.5 | 55 | 130 |
| Example A2 | B | A2-3 | Toka black (#4400 from Tokai Carbon Co., Ltd.) | 6 | 40 | 168 |
| Example A3 | C | A3-1 | KETJEN BLACK EC300J from Lion Corp. | 9 | 40 | 360 |
| Example A4 | D | A4-1 | Acetylene black (granulated DENKA BLACK from Denka Company Limited) | 9 | 35 | 160 |
| Example A5 | E | A5-3 | Acetylene black (granulated DENKA BLACK from Denka Company Limited) | 9 | 35 | 160 |
| Comparative Example A1 | F | A6-1 | Toka black (#4400 from Tokai Carbon Co., Ltd.) | 6 | 40 | 168 |
| Comparative Example A2 | G | A7-2 | Acetylene black (granulated DENKA BLACK from Denka Company Limited) | 9 | 35 | 160 |

| | | | Belt Properties | |
|---|---|---|---|---|
| | Belt | Pellet | Abundance Ratio of Conductive Filler in Island Portion | Resistance Deviation |
| Example A1 | A | A1-1 | 73 | 0.98 |
| Example A2 | B | A2-3 | 73 | 0.90 |
| Example A3 | C | A3-1 | 70 | 0.75 |
| Example A4 | D | A4-1 | 68 | 0.52 |
| Example A5 | E | A5-3 | 42 | 0.65 |
| Comparative Example A1 | F | A6-1 | 78 | 1.18 |

TABLE 1-continued

| | | | | |
|---|---|---|---|---|
| Comparative Example A2 | G | A7-2 | 38 | 1.38 |

In Examples A1 to A5, since 40% to 75% of the conductive filler are present in the resin in the island portion, each of the belts has a resistance deviation not greater than 1. Each of Comparative Example A1 larger than 75% and Comparative Example A2 smaller than 40% has a resistance deviation greater than 1, i.e., resistance largely varies.

Compared Example A1 with Example A2, Example A2 having smaller average primary particle diameter has smaller resistance deviation. Compared Example A2 with Example A3, Example A3 in which carbon black has a pH not less than 9 has smaller resistance deviation. Compared Example A3 with Example A4, Example A4 in which carbon black has an oil absorption not greater than 200 $cm^3$/100 g has smaller resistance deviation.

Compared Example A2 and Comparative Example A1, each of the pellets was prepared by the same materials, but all the materials were processed at once in Comparative Example A1 and the conductive filler was added to each of the resin materials in Example A2. The conductive filler was added to each of the resin materials to control the conductive filler present in the resin in the island portion to be 40% to 75% based on total of the conductive fillers and decrease the resistance deviation.

Example B1

Materials

Thermoplastic Resin 1 (Sea Portion Resin): Polyvinylidene fluoride (Kynar 720 from Arkema)

Thermoplastic Resin 2 (Island Portion Resin): Polyether ester amide (PELECTRON AS from Sanyo Chemical Industries, Ltd.).

Conductive filler: Furnace black (#3030B from Mitsubishi Chemical Corp.)

<Kneading Conditions>

Eighty-five (86) parts of the thermoplastic resin 1, 7 parts of the thermoplastic resin 2 and 7 parts of the conductive filler were placed in HENSCHEL MIXER SPM from KAWATA MFG Co., Ltd. and stirred therein to prepare a powder in which the materials were mixed. Next, the powder was melted and kneaded at from 180° C. to 220° C. by a biaxial kneader TEM from Toshiba Machine Co., Ltd., and pelletized to prepare a pellet. Further, the pellet was kneaded twice by the biaxial kneader to prepare a pellet B1-1.

<Method of Preparing Seamless Belt>

Next, the pellet B1-1 was placed in a cylindrical die for melting, kneading and extrusion molding at 200° C. to prepare a seamless belt B having a circumferential length of 960 mm and a thickness of 120 μm.

<Measurement of Thermoplastic Resin 2>

Properties of the thermoplastic resin 2 (island portion resin) were measured as follows. The surface free energy of the thermoplastic resin 1 (sea portion resin) was measured as well.

<<Crystallization Temperature>>

[Measurer]

DSC: Q2000 from TA Instruments

[Measurement Conditions]

Sample container: Aluminum sample pan (with a lid)

Sample Quantity: 5 mg

Reference aluminum sample pan (empty container)

Atmosphere: Nitrogen (flow rate 50 mL/min)

Starting Temperature: −20° C.

Temperature Rising Speed: 10° C./min

Finishing Temperature: 230° C.

Hold Time: 1 min

Temperature Falling Speed: 10° C./min

Finishing Temperature: −50° C.

Hold Time: 5 min

Temperature Rising Speed: 10° C./min

Finishing Temperature: 230° C.

A maximum endothermic peak temperature in the temperature falling process was a crystallization temperature.

<<Measurement of Surface Free Energy (Measurement of Contact Angle)>>

The surface free energy was measured by an automatic contact angle meter DM-701 from Kyowa Interface Science Co., LTD. Each of the thermoplastic resins was modified to have the shape of a plate. A droplet of three solvents, i.e., water, diodomethane and ethylene glycol was dropped on the plate to measure a contact angle. A software provided with the apparatus was used for analysis to determine a surface free energy of the thermoplastic resin. Kitazaki-Hatake formula was used for the analysis.

<<Bleed Rate to Distilled Water>>

The bleed rate was measured by the following method.

First, the thermoplastic resin 2 in the island portion (weight A=0.4 g) and distilled water (weight B=34 g) were contained in a glass container. The glass container was sealed and dried for 1 hr by a drier at 45° C. The dried glass container was oscillated by an ultrasonic oscillation generator for 40 min, and dried again for 8 hrs by the drier at 45° C. Distilled water extraction liquid (weight D) in the glass container taken out from the drier was put in a glass petri dish (weight c).

After the petri dish is dried by a drier for 3 hrs at 105° C., the petri dish was taken out from the drier and cooled for 1 hr by air and measured in which a solid content was precipitated (weight E). Weights A to E were put into the following formula to determine the bleed rate $$\text{The bleed rate to distilled water (\%)}=((E-C)/((A/B)\times D))\times 100$$

<<Measurement of Surface Specific Resistivity>>

The surface specific resistivity was measured according to ASTM D257.

<Measurement of Conductive Filler>

Properties of the conductive filler were measured as follows.

<<Measurement of pH>> pH was measured by a pH meter HM-30G from TOA CHEMICAL Co., LTD. at 25° C.

<<Measurement of Average Primary Particle Diameter>>

The average primary particle diameter was measured by observing carbon black particles with an electron microscope to determine an arithmetic average diameter.

<<Measurement of DBP Oil Absorption>>

The DBP oil absorption was measured according to JIS K6217-4.

<Measurement of Seamless Belt>

Next, the seamless belt B1 was evaluated as follows.

<<Sea-Island Structure>>

A ratio of the conductive filler present in the island portion was determined by photographing a cross section of a sample with an SEM to calculate a total sum of areas of the conductive filler present in the island portion and an areal ratio of the conductive filler present in the sea portion.

<<Measurement of Content of Conductive Filler>>

The content of the conductive filler was determined by calculating a ratio of a total sum of areas of the conductive filler included in the thermoplastic resin 2 (island portion resin) to a total sum of areas of the conductive filler included in the thermoplastic resin 1 (sea portion resin) on the basis of the SEM image. Specifically, the SEM image was read using an image processing software, the image was digitalized on the basis of image brightness to separate the thermoplastic resin from the conductive filler, and selecting an image processing range to determine an area of each of the conductive fillers.

<<Measurement of Surface Resistivity>>

Thirty-two (32) points of the seamless belt B1 at an interval of 30 mm in a circumferential direction were measured by under an environment of 23° C. and 50% with an application bias 500V with a resistance measurer (HIRESTA URS probe from Mitsubishi Chemical Analytech Co., Ltd.) using an insulative plate.

<<Evaluation of Variation Range of Surface Resistivity>>

A difference between a maximum value and a minimum value of common logarithm values of the 32 points was determined as a variation of the resistivity.

<<Evaluation of Bleed>>

The seamless belt B1 was cut to have the shape of a strip having a size of 40 mm×130 mm and wound around an image bearer taken out from an image forming apparatus. The image bearer was stored in an environment of 50° C. and 98RH for 14 days.

The strip-shaped seamless belt wound round the image bearer was taken out therefrom and the image bearer was installed in the image forming apparatus to produce a magenta-colored halftone image. The image was visually observed to see whether a portion thereof the belt was wound around had abnormal images such as voids.

The evaluation results of the thermoplastic resin 2 (island portion resin), the conductive filler and the seamless belt are shown in Tables 2 and 3.

Example B2

The procedures for preparation and evaluation of the seamless belt B1 in Example B1 were repeated except for replacing the thermoplastic resin in the island portion as shown in Table 2 to prepare a pellet B2-1 and a seamless belt B2. The results are shown in Tables 2 and 3.

Example B3

The procedures for preparation and evaluation of the seamless belt B1 in Example B1 were repeated except for replacing the thermoplastic resin in the island portion as shown in Table 2 to prepare a pellet B3-1 and a seamless belt B3. The results are shown in Tables 2 and 3.

Example B4

The procedures for preparation and evaluation of the seamless belt B1 in Example B1 were repeated except for replacing the conductive filler as shown in Table 2 and changing the kneading method as follows to prepare a pellet B4-3 and a seamless belt B4. The results are shown in Tables 2 and 3.

—Kneading 1—

Ninety-two point five (92.5) parts of the thermoplastic resin 1 (Sea Portion Resin) and 7.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet B4-1.

—Kneading 2—

Ninety-nine point five (99.5) parts of the thermoplastic resin 2 (Island Portion Resin) and 0.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet B4-2.

—Kneading 3—

Ninety-two (92) parts of the pellet B4-1 and 8 parts of the pellet B4-2 were melted and kneaded once by a biaxial kneader TEM from Toshiba Machine Co., Ltd., and pelletized to prepare the pellet B4-3.

Example B5

The procedures for preparation and evaluation of the seamless belt B1 in Example B1 were repeated except for replacing the conductive filler as shown in Table 2 to prepare a pellet B5-1 and a seamless belt B5. The results are shown in Tables 2 and 3.

Example B6

The procedures for preparation and evaluation of the seamless belt B1 in Example B1 were repeated except for replacing the conductive filler as shown in Table 2 to prepare a pellet B6-1 and a seamless belt B6. The results are shown in Tables 2 and 3.

Example B7

The procedures for preparation and evaluation of the seamless belt B4 in Example B4 were repeated except for replacing the conductive filler as shown in Table 2 to prepare a pellet B7-3 and a seamless belt B7. The results are shown in Tables 2 and 3.

Example B8

The procedures for preparation and evaluation of the seamless belt B1 in Example B1 were repeated except for replacing the thermoplastic resin in the island portion and the conductive filler as shown in Table 2 to prepare a pellet B8-1 and a seamless belt B8. The results are shown in Tables 2 and 3.

Example B9

The procedures for preparation and evaluation of the seamless belt B6 in Example B6 were repeated except for replacing the thermoplastic resin in the island portion as shown in Table 2 to prepare a pellet B9-1 and a seamless belt B9. The results are shown in Tables 2 and 3.

Example B10

The procedures for preparation and evaluation of the seamless belt B6 in Example B6 were repeated except for replacing the thermoplastic resin in the island portion as shown in Table 2 to prepare a pellet B10-1 and a seamless belt B1. The results are shown in Tables 2 and 3.

Comparative Example B1

The procedures for preparation and evaluation of the seamless belt B4 in Example B4 were repeated except for changing the kneading method as follows 2 to prepare a pellet B11-3 and a seamless belt B11. The results are shown in Tables 2 and 3.

<Kneading Conditions>

Eighty-five (85) parts of the thermoplastic resin in the sea portion, 7 parts of the thermoplastic resin in the island portion and 6 parts of the conductive filler were placed in HENSCHEL MIXER SPM from KAWATA MFG Co., Ltd. and stirred therein to prepare a powder in which the materials were mixed. Next, the powder was melted and kneaded by a biaxial kneader TEM from Toshiba Machine Co., Ltd., and pelletized to prepare a pellet. Further, the pellet was kneaded twice by the biaxial kneader to prepare a pellet B11-1.

Comparative Example B2

The procedures for preparation and evaluation of the seamless belt B7 in Example B7 were repeated except for replacing the changing the kneading method as follows to prepare a pellet B12-3 and a seamless belt B12. The results are shown in Tables 2 and 3.

—Kneading 4—

Ninety-two point five (92.5) parts of the thermoplastic resin 1 (Sea Portion Resin) and 7.5 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet B12-1.

—Kneading 5—

Ninety-nine point nine (99.9) parts of the thermoplastic resin 2 (Island Portion Resin) and 0.1 parts of the conductive filler were placed in HENSCHEL MIXER SPM from KAWATA MFG Co., Ltd. and stirred therein to prepare a powder in which the materials were mixed. The powder was melted and kneaded once by a biaxial kneader TEM from Toshiba Machine Co., Ltd., and pelletized to prepare a pellet B12-2.

—Kneading 3—

Ninety-two (92) parts of the pellet B12-1 and 8 parts of the pellet B12-2 were melted and kneaded once by a biaxial kneader TEM from Toshiba Machine Co., Ltd., and pelletized to prepare the pellet B12-3.

TABLE 2

| | Thermoplastic Resin Thermoplastic Resin 1 (Sea Portion Resin) | | |
|---|---|---|---|
| | Name | Crystallization Temperature Tc1 (° C.) | Surface Free Energy γ1 (mj/m$^2$) |
| Example B1 | Polyvinylidene fluoride (Kynar 720 from Arkema) | 135.1 | 44.3 |
| Example B2 | Polyvinylidene fluoride (Kynar 720 from Arkema) | 135.1 | 44.3 |
| Example B3 | Polyvinylidene fluoride (Kynar 720 from Arkema) | 135.1 | 44.3 |
| Example B4 | Polyvinylidene fluoride (Kynar 720 from Arkema) | 135.1 | 44.3 |
| Example B5 | Polyvinylidene fluoride (Kynar 720 from Arkema) | 135.1 | 44.3 |
| Example B6 | Polyvinylidene fluoride (Kynar 720 from Arkema) | 135.1 | 44.3 |
| Example B7 | Polyvinylidene fluoride (Kynar 720 from Arkema) | 135.1 | 44.3 |
| Example B8 | Polyvinylidene fluoride (Kynar 720 from Arkema) | 135.1 | 44.3 |
| Example B9 | Polyvinylidene fluoride (Kynar 720 from Arkema) | 135.1 | 44.3 |
| Example B10 | Polyvinylidene fluoride (Kynar 720 from Arkema) | 135.1 | 44.3 |
| Comparative Example B1 | Polyvinylidene fluoride (Kynar 720 from Arkema) | 135.1 | 44.3 |
| Comparative Example B2 | Polyvinylidene fluoride (Kynar 720 from Arkema) | 135.1 | 44.3 |

| | Thermoplastic Resin Thermoplastic Resin 2 (Island Portion Resin) | | | | |
|---|---|---|---|---|---|
| | Name | Crystallization Temperature Tc1 (° C.) | Surface Free Energy γ2 (mj/m$^2$) | Bleed Rate (%) | Wt. % (based on total materials) |
| Example B1 | Polyether ester amide (PELECTRON AS from Sanyo Chemical Industries, Ltd.) | 135.7 | 191.3 | 5.85 | 7 |

TABLE 2-continued

| | | | | | |
|---|---|---|---|---|---|
| Example B2 | Polyamide/polyether copolymer (PEBAX MH2030 from Arkema) | 137.1 | 94.2 | 3.9 | 7 |
| Example B3 | Polyamide/polyether copolymer (PEBAX MH1657 from Arkema) | 140.3 | 105.7 | 2.6 | 7 |
| Example B4 | Polyether ester amide (PELECTRON AS from Sanyo Chemical Industries, Ltd.) | 135.7 | 191.3 | 5.85 | 7 |
| Example B5 | Polyether ester amide (PELECTRON AS from Sanyo Chemical Industries, Ltd.) | 135.7 | 191.3 | 5.85 | 7 |
| Example B6 | Polyether ester amide (PELECTRON AS from Sanyo Chemical Industries, Ltd.) | 135.7 | 191.3 | 5.85 | 7 |
| Example B7 | Polyether ester amide (PELECTRON AS from Sanyo Chemical Industries, Ltd.) | 135.7 | 191.3 | 5.85 | 7 |
| Example B8 | Polyamide/polyether copolymer (PEBAX MH1657 from Arkema) | 140.3 | 105.7 | 2.6 | 7 |
| Example B9 | Polyolefin/polyether copolymer (Irgastat P18FCA from BASF) | 142.1 | 76.9 | 2.5 | 7 |
| Example B10 | Polyamide/polyether copolymer (H151 from T&K) | 136.3 | 48.3 | 0.8 | 7 |
| Comparative Example B1 | Polyether ester amide (PELECTRON AS from Sanyo Chemical Industries, Ltd.) | 135.7 | 191.3 | 5.85 | 7.1 |
| Comparative Example B2 | Polyether ester amide (PELECTRON AS from Sanyo Chemical Industries, Ltd.) | 135.7 | 191.3 | 5.85 | 8 |

| | Thermoplastic Resin | | Conductive Filler | | | |
|---|---|---|---|---|---|---|
| | Tc2 − Tc1 (° C.) | γ2 − γ1 (mj/m$^2$) | Name | pH | Average Primary Particle Diameter (nm) | DBP Oil Absorption (cm3/100 g) |
| Example B1 | 0.6 | 147 | Furnace black (#3030B from Mitsubishi Chemical Corp.) | 6.5 | 55 | 130 |
| Example B2 | 2 | 49.9 | Furnace black (#3030B from Mitsubishi Chemical Corp.) | 6.5 | 55 | 130 |
| Example B3 | 5.2 | 61.4 | Furnace black (#3030B from Mitsubishi Chemical Corp.) | 6.5 | 55 | 168 |
| Example B4 | 0.6 | 147 | Toka black (#4400 from Tokai Carbon Co., Ltd.) | 6 | 40 | 360 |
| Example B5 | 0.6 | 147 | KETJEN BLACK EC300J from Lion Corp. | 9 | 40 | 160 |
| Example B6 | 0.6 | 147 | Acetylene black (granulated DENKA BLACK from Denka Company Limited) | 9 | 35 | 160 |
| Example B7 | 0.6 | 147 | Acetylene black (granulated DENKA BLACK from Denka Company Limited) | 9 | 35 | 160 |
| Example B8 | 5.2 | 61.4 | Acetylene black (granulated DENKA BLACK from Denka Company Limited) | 9 | 35 | 160 |
| Example B9 | 7 | 32.6 | Acetylene black (granulated DENKA BLACK from Denka Company Limited) | 9 | 35 | 160 |
| Example B10 | 1.2 | 4 | Acetylene black (granulated DENKA BLACK from Denka Company Limited) | 9 | 35 | 160 |
| Comparative Example B1 | 0.6 | 147 | Toka black (#4400 from Tokai Carbon Co., Ltd.) | 6 | 40 | 168 |
| Comparative Example B2 | 0.6 | 147 | Acetylene black (granulated DENKA BLACK from Denka Company Limited) | 9 | 35 | 160 |

TABLE 3

| | Belt Properties | | | | |
|---|---|---|---|---|---|
| | Belt | Pellet | Abundance Ratio of Conductive Filler in Island portion | Resistance Deviation | Photoconductor Contamination Left in High Temperature & High Humidity Image Evaluation |
| Example B1 | B1 | B1-1 | 74 | 0.99 | Void on the 1$^{st}$ image. Void completely disappeared when 15 images were produced. |

TABLE 3-continued

| | Belt | Pellet | Belt Properties: Abundance Ratio of Conductive Filler in Island portion | Belt Properties: Resistance Deviation | Photoconductor Contamination Left in High Temperature & High Humidity Image Evaluation |
|---|---|---|---|---|---|
| Example B2 | B2 | B2-1 | 71 | 0.8 | Low image density disappeared when 5 images were produced. No problem in practical use. |
| Example B3 | B3 | B3-1 | 71 | 0.82 | None |
| Example B4 | B4 | B4-3 | 74 | 0.93 | Void on the 1st image. Void completely disappeared when 15 images were produced. |
| Example B5 | B5 | B5-1 | 72 | 0.78 | Void on the 1st image. Void completely disappeared when 15 images were produced. |
| Example B6 | B6 | B6-1 | 70 | 0.53 | Void on the 1st image. Void completely disappeared when 15 images were produced. |
| Example B7 | B7 | B7-3 | 41 | 0.67 | Void on the 1st image. Void completely disappeared when 15 images were produced. |
| Example B8 | B8 | B8-1 | 70 | 0.33 | None |
| Example B9 | B9 | B9-1 | 73 | 0.64 | None |
| Example B10 | B10 | B10-1 | 71 | 0.78 | None |
| Comparative Example B1 | B11 | B11-3 | 78 | 1.18 | Void on the 1st image. Void completely disappeared when 15 images were produced. |
| Comparative Example B2 | B12 | B12-3 | 38 | 1.38 | Serious void. Problem is practical use. Not disappeared even when 30 images were produced. |

In Examples B1 to B10, since 40% to 75% of the conductive filler are present in the resin in the island portion, each of the belts has a resistance deviation not greater than 1. Each of Comparative Example B1 larger than 75% and Comparative Example B2 smaller than 40% has a resistance deviation greater than 1. In addition, Tc1<Tc2 and the resistance deviation is not greater than 1.

Compared Example B6 with Example B10, Example B6 in which γ2−γ1 is not less than 30 mj/m$^2$ has less variation of surface resistivities than Example B10.

Compared Example B1 with Example B3, Example B3 in which Tc2−Tc1 is not less than 5° C. has less variation of surface resistivities than Example B1. Compared Example B1 with Example B4, Example B4 in which an average primary particle diameter is smaller has less variation of surface resistivities than Example B1. Compared Example B4 with Example B5, Example B5 in which pH is not less than 9 has less variation of surface resistivities than Example B4. Further, compared Example B5 with Example B6, Example B6 in which DBP oil absorption is not greater than 200 cm3/100 g has less variation of surface resistivities than Example B5. In addition, Examples in which the bleed rate is not greater than 4% produce quality images even after left in an environment of high temperature and high humidity.

Having now fully described the invention, it will be apparent to one of ordinary skill in the art that many changes and modifications can be made thereto without departing from the spirit and scope of the invention as set forth therein.

What is claimed is:

1. A semiconductive resin composition, comprising:

at least two thermoplastic resins; and a conductive filler, wherein the two thermoplastic resins form a sea-island structure in which one of the two thermoplastic resins forms a sea portion and another of the two thermoplastic resins forms one or more island portions, and in a cross section observed with a scanning electron microscope, an abundance ratio of the conductive filler in the one or more island portions of the sea-island structure to that in the sea portion and the one or more island portions is 40% to 75%.

2. The semiconductive resin composition of claim 1, wherein the following relation is satisfied:

$$Tc1<Tc2$$

wherein Tc1 represents a crystallization temperature of the thermoplastic resin in the sea portion of the sea-island structure and Tc2 represents a crystallization temperature of the thermoplastic resin in the one or more island portions thereof.

3. The semiconductive resin composition of claim 2, wherein a difference between Tc2 and Tc1 (Tc2−Tc1) is not less than 5° C.

4. The semiconductive resin composition of claim 1, wherein the following relation is satisfied:

$$\gamma2-\gamma1\geq30\ \text{mJ/m2}$$

wherein γ1 represents a surface free energy of the thermoplastic resin in the sea portion of the sea-island structure and γ2 represents a surface free energy of the thermoplastic resin in the one or more island portions thereof.

5. The semiconductive resin composition of claim 1, wherein the conductive filler is carbon black.

6. The semiconductive resin composition of claim 5, wherein the carbon black has an average primary particle diameter of from 10 nm to 40 nm.

7. The semiconductive resin composition of claim 5, wherein the carbon black has a DBP oil absorption not greater than 200 cm$^3$/100 g.

8. A seamless belt member for electrophotography, comprising a semiconductive resin composition comprising:

at least two thermoplastic resins; and a conductive filler, wherein the two thermoplastic resins form a sea-island structure in which one of the two thermoplastic resins forms a sea portion and another of the two thermoplastic resins forms one or more island portions, and wherein the sea-island structure is configured to decrease variation of resistance in the seamless belt member, and in a cross section observed with a scanning electron microscope, an abundance ratio of the conductive filler in the one or more island portions of the sea-island structure to that in the sea portion and the one or more island portions is 40% to 75%.

9. An image forming apparatus, comprising:

an electrostatic latent image bearer;

an electrostatic latent image former to form an electrostatic latent image on the electrostatic latent image bearer;

an image developer to develop the electrostatic latent image with a toner to form a visible image;

a transferer to transfer the visible image onto a recording medium; and a seamless belt member for electrophotography, comprising a semiconductive resin composition comprising:

at least two thermoplastic resins; and a conductive filler, wherein the two thermoplastic resins form a sea-island structure in which one of the two thermoplastic resins forms a sea portion and another of the two thermoplastic resins forms one or more island portions, and wherein the sea-island structure is configured to decrease variation of resistance in the seamless belt member, and in a cross section observed with a scanning electron microscope, an abundance ratio of the conductive filler in the one or more island portions of the sea-island structure to that in the sea portion and the one or more island portions is 40% to 75%.

* * * * *